United States Patent [19]

Goetz et al.

[11] Patent Number: 4,596,632

[45] Date of Patent: Jun. 24, 1986

[54] APPARATUS AND PROCESS FOR A DECURLING SYSTEM

[75] Inventors: William J. Goetz; Thomas G. Engel, both of Appleton, Wis.

[73] Assignee: Appleton Papers Inc., Appleton, Wis.

[21] Appl. No.: 381,890

[22] Filed: May 25, 1982

Related U.S. Application Data

[63] Continuation-in-part of Ser. No. 257,946, Apr. 27, 1981, abandoned.

[51] Int. Cl.[4] ..... D21F 11/00

[52] U.S. Cl. ..... 162/136; 162/197; 162/207; 162/271

[58] Field of Search ..... 162/207, 197, 270, 271, 162/136

[56] References Cited

U.S. PATENT DOCUMENTS

| | | | |
|---|---|---|---|
| 3,257,734 | 6/1966 | Broadway et al. | 162/207 |
| 3,467,541 | 9/1969 | Aronsson et al. | 162/207 |
| 4,207,143 | 6/1980 | Glomb et al. | 162/207 |

*Primary Examiner*—Peter Chin

*Attorney, Agent, or Firm*—Birch, Stewart, Kolasch & Birch

[57] ABSTRACT

An apparatus and process are disclosed for an efficient decurling system wherein a web material is introduced into a steam environment such that the distance between the web and the steam source is maintained substantially constant.

13 Claims, 2 Drawing Figures

APPARATUS AND PROCESS FOR A DECURLING SYSTEM

Figure 1:
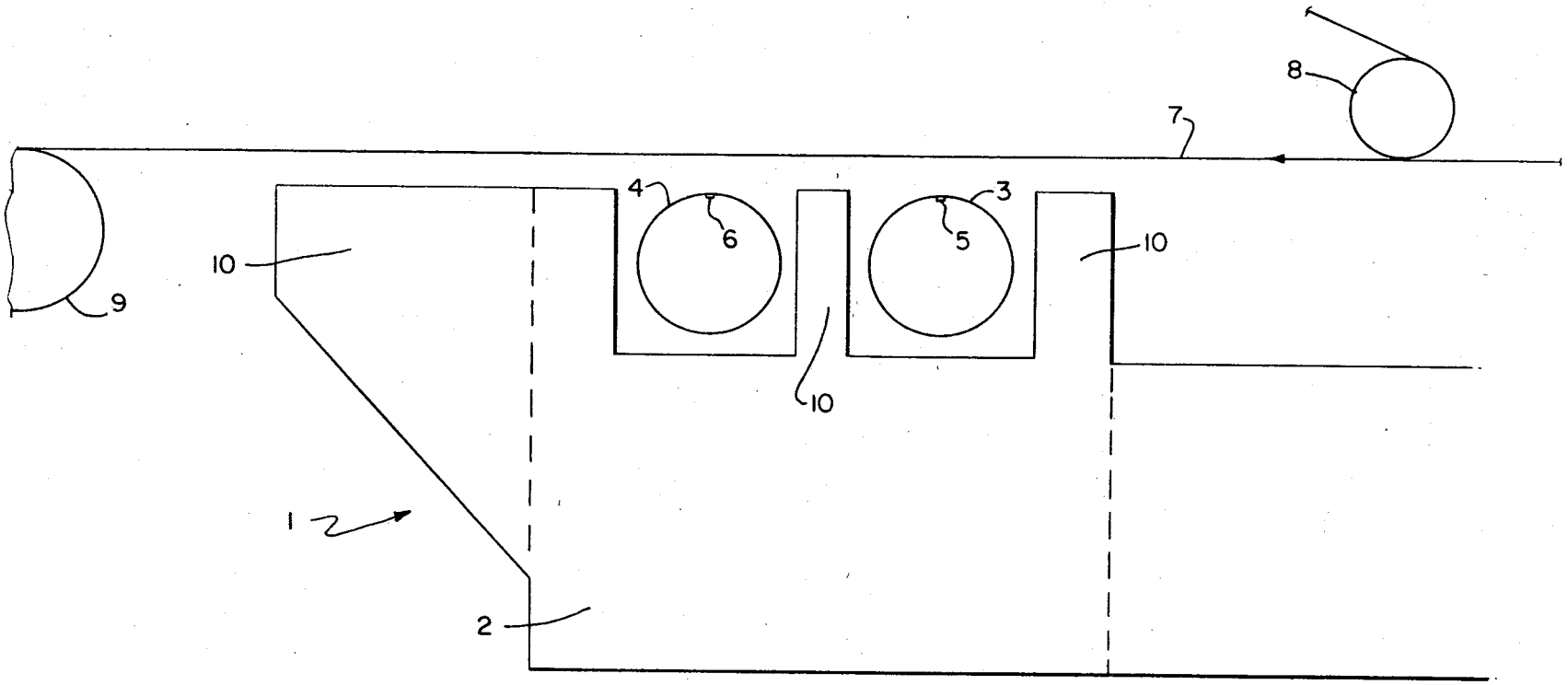
PRIOR ART FIG. 1

This application is a continuation-in-part of U.S. application Ser. No. 257,946, filed Apr. 27, 1981, now abandoned and relates to a decurling operation and, more specifically, to a steam shower decurling system which is markedly more efficient and effective in achieving improved decurling capacity than traditional steam shower operations.

As is commonly known, when a web material is supplied in the form of a roll, there is an initial curl in the web depending on such factors as the length of time the roll has been stored in stock and variation in the roll diameter, such as the curvature of the different convolutions making up the roll. In order to compensate for these influences on the straightness of a web, it has been found necessary to provide certain prescribed treatments to straighten the web material such as described in U.S. Pat. Nos. 3,185,616 and 3,649,447, so that when it is ultimately cut into sheets, the handling of the sheets may be facilitated and the undesirable curling effect eliminated. While these existing devices for straightening webs have been found useful, they have not been altogether satisfactory in the sense that they are expensive and/or require complicated mechanisms.

In the case of paper, it is known that increasing the moisture content of the paper will lead to less trouble from curling than paper having a lower moisture content. With respect to a coated sheet, for example, it is known that the latter will tend to curl towards the last side coated, and, thus, moisture is applied to the side opposite to which the sheet otherwise would tend to curl. Thus, as regards the paper industry, the controlled and uniform application of moisture to raw stock and/or coated webs is a goal of distinct importance.

Several methods have been proposed for applying moisture to a moving sheet or web. Examples of these include roll applicators such as the Dahlgren-type systems, electrostatic systems such as disclosed in U.S. Pat. No. 3,467,541 and steam shower devices. Other examples for adding moisture to a web include a method and apparatus for applying steam to and condensing moisture on a web that is backed by a heat conducting body, as disclosed in U.S. Pat. No. 2,370,811 and a device that directs a humid atmosphere towards the web, as disclosed in U.S. Pat. No. 3,238,635.

While these and other techniques have been found useful in applying moisture to a paper work piece so as to minimize the undesirable curling properties of the paper, there have been found inherent disadvantages in their use. In one instance, for example, condensation of steam vapor on the web is produced because the web is backed by a heat sink or metal roll through which a cooling fluid is passed. In the case where humid atmosphere is directed toward the web, the system has been proven to be inefficient. Furthermore, in the case where steam showers are employed directly, decurling has been strictly governed by the steam pressure employed at the shower head. Lack of effective decurling leads to the utilization or reliance upon excessive steam pressures and/or reduced machine speeds. A change in pressure has been demonstrated to have an effect on other important variables such as the web temperature, web-to-shower distance and steam billowing. In addition, decurling regulated by steam pressure alone is uneconomical and inefficient. With a free floating web, a high level of exhaust is required to counter the rise in web-to-shower distance and to control the billowing effect resulting from the additional steam usage, the increased amount of steam required, which is essential to decurling, being drawn away by the exhaust. The resulting lack of decurling capacity leads to costly limitations on both quantity and quality.

It is, therefore, an object of the present invention to provide a steam decurling system for a web material, such as a coated paper stock, which will overcome the above-noted disadvantages.

It is a further object of the present invention to provide a steam decurling configuration which stabilizes the web material in the vicinity of the site of steam emission.

It is another object of the present invention to provide a steam decurling apparatus and process which effectively regulates the distance of the web material to the steam shower under variable operating conditions.

Still, a further object of the present invention is to provide a system whereby the web-to-shower distance is maintained relatively constant without contact with the web material.

Another object of the present invention is to provide a steam decurling system which eliminates fluttering of the treated web material to produce a more uniform steam application and penetration.

It is still another object of the present invention to effectively cool the web so as to realize more efficient steam condensation.

Yet, still a further object of the present invention is to provide a decurling configuration wherein the area about the steam shower is confined so as to closely control the billowing effect produced by the steam with minimal exhaust.

Yet, another object of the present invention is to provide an effective decurling operation while substantially reducing the amount of normal steam pressure required during the process.

The foregoing objects and others are accomplished in accordance with the present invention, generally speaking, by providing a steam decurling system wherein a paper web, or the like, is driven through a steam shower environment for purposes of increasing the moisture content of the web material. The steam showers are emitted from a source, such as a steam pipe, from beneath the surface of the web material. Positioned above the web and spaced therefrom is at least one air source assembly so designed to effectively control and regulate the distance of the web-to-steam shower source under variable operating conditions without contacting the web material. By carefully controlling the distance between the web material and the source of the steam, the deposit of the steam on the web surface is more uniform and the resulting decurling effect more dynamic. It is preferred that the air foils to positioned just prior to the outlet for the steam from the respective steam source. The above-described method and configuration provide for a close regulation of those factors which have the most influential effect upon a decurling operation.

It has been determined in the course of the present invention that the factors found to be most significant in controlling the curling effect related to paper technology and, more specifically, to the fabrication of coated paper webs are the web-to-moisture source distance, web temperature, steam pressure and exhaust level. By implementing the system of the present invention, the regulation of these factors has been effectively achieved. The configuration of the present invention provides for reliable control of the distance between the web material and the source of the steam shower without contacting the web material which effectively eliminates the fluttering effect resulting from excessive steam pressures applied, producing a more uniform steam application and penetration. The utilization of the air foil system has an additional cooling effect upon the web surface, thus causing more efficient steam condensation on the web. By confining the area about the steam shower, the billowing effect produced by the steam, under pressure, is minimized, thus eliminating the necessity of extreme exhaust conditions.

Figure 2:
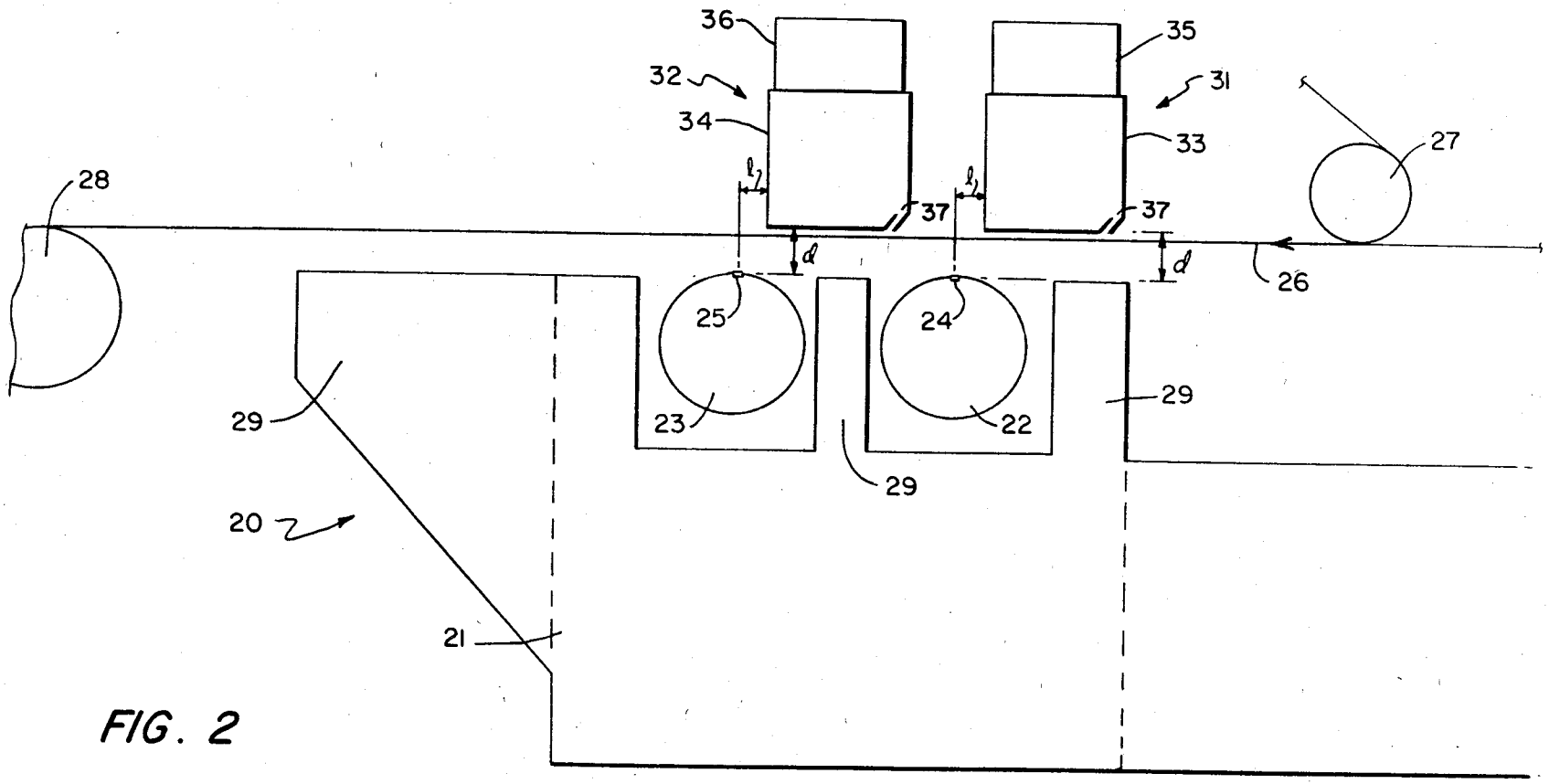

The invention is further illustrated by way of the accompanying drawings wherein FIG. 1 represents a conventional steam shower decurling configuration and FIG. 2 represents the steam shower decurling system of the present invention.

Referring now to FIG. 1, there is seen a steam shower decurling structure, generally designated 1, consisting of a steam shower housing 2 and the sources of steam represented herein as two steam pipes 3 and 4 with related orifices 5 and 6. A web material 7 from feed roll 8 passes above the steam pipes 3 and 4 and is taken up on idle roll 9. Exhaust chambers 10 are provided for removal of excess steam. In the instant illustration, decurling is regulated by steam pressure alone with a free-floating web. Under these conditions, the steam pressure applied adversely effects the resulting web-to-steam shower distance and leads to excessive steam billowing. In order to counter this effect, high level exhausting is implemented which leads to excessive removal of steam by the exhaust system, therefore requiring a step up in steam usage.

In FIG. 2 is seen the steam decurling unit of the present invention, generally designated 20, comprising the steam shower housing 21 containing the steam sources, herein represented as steam pipes 22 and 23. The steam showers are emitted from the steam pipe orifices 24 and 25, respectively. The web sheet 26 from feed roll 27 is introduced above the steam pipes 22 and 23 to take up roll 28. Positioned above the web material are two air foil assembly units, generally designated 31 and 32. Each air foil assembly comprises air foil housings 33 and 34 and infeed ducts 35 and 36 attached to some remote air blower (not shown). Exhaust units 29 are provided for the controlled venting of the steam during the steam shower process. When the moisture is uniformly applied to a coated web or paper sheet, the web is fed in a manner such that the moisture is applied to the side opposite to which the coating was last applied.

Each foil is positioned or offset just prior to the steam pipe orifices 24 and 25 such that the leading edges of the air foil units 33 and 34 are located approximately ½" to ¾" prior to the orifice or center line of the representative steam pipes 22 and 23. The foil pressure is maintained such that the web material 26 floats uniformly between the foil units 33 and 34 and the sources of the steam showers 22 and 23 so that the distance between the steam pipe orifices and the web material is maintained substantially constant. For optimum results, it is preferred that this distance between the web and steam shower orifice be about ½ the distance (d) between the air foil and the steam shower source. The preferred range of distance (d) is from about ¼ inch to about 1½ inches. The offset of the air foils from the steam pipe orifices avoids potential damage to the web surface due to high steam pressures while providing a cushioning effect on the web in the area immediately above the steam pipe orifices. The utilization of the air foil maintains the web-to-steam source distance constant without contacting the surface of the web material. This is especially significant when the upper surface of the web material has a coating thereon. Elimination of unnecessary contact reduces the possibility of imparting surface impairment to the web. More specifically, the air foils incorporate the venturi effect, similar to that experienced at the surface of an airplane wing, into the system whereby the air is emitted through foil orifice 37 so as to establish a uniform air film pattern directed parallel to the surface of the web 26, preventing contact of the web with the foils while maintaining the web at a position near the foil surface.

The utilization of the air foils of the present invention to maintain a fixed steam pipe-to-web distance insures that the deposition of steam on the web surface is more uniform, thus resulting in a more satisfactory decurling process. Furthermore, the presence of the air foil stabilizes the web in the vicinity immediately above the steam pipe orifices while preventing web contact with either the foil surface or the steam pipes, with the air film promoting temperature reduction enabling adequate and sufficient steam condensation at the web surface. The preferred air foils pressure range is from about 7 to 9 inches of water. Steam pressure is generally regulated at about 5 lbs. with it being preferred that the steam pressure not exceed 30 lbs. Furthermore, with the increase of the speed of the web material, it has generally been found necessary to increase the steam pressure in order to penetrate the air film barrier along the web surface. In the case of the present invention, the increase in the web speed does not necessarily require an increase in steam pressure in order to achieve the desired surface exposure to the moisture.

Although in the present illustration the configuration has been represented as containing two steam sources adjacent the two air foil units, this is for purposes of describing the system of the present invention and is not intended to be a limiting factor thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The embodiments of the invention in which an exclusive property or privilege is claimed are defined as follows:

1. A steam decurling apparatus comprising means for introducing a web material to a steam environment, means for emitting steam showers to a first surface of said web material, and a web stabilizing means provided on the side of said web material opposite said steam shower means which provides a uniform air film directed parallel to a second surface of said film which serves to stabilize said web material in the vicinity of said steam showers without contacting said web material, simultaneously maintaining a substantially constant distance between the respective surface of said web material and said steam shower means, said air stabilizing means being positioned relative to said web material prior to the emission of said steam showers.

2. The apparatus of claim 1 wherein said steam shower means comprises at least one steam pipe means having a steam emitting orifice located at the center line thereof beneath said web material which directs steam showers onto the surface of said web material.

3. The apparatus of claim 2 wherein said web stabilizing means comprises at least one air foil positioned above and prior to corresponding steam pipe means such that said parallel air film maintains said web material in a suspended state between each of said air foils and said steam pipes.

4. A process of uniformly applying moisture to the surface of a web material which comprises introducing said web material into a zone above at least one steam source, subjecting a first surface of said web material facing said steam source to a steam shower while substantially simultaneously therewith directing a uniform air film pattern under pressure from at least one corresponding air supply means parallel to a second opposite surface of said web material providing a uniform air film parallel to said second surface so as to effectively maintain the distance between said web material and said source of steam showers substantially constant while at the same time maintaining said web material free from contact with either of said steam source and said air supply means, said corresponding air supply means being positioned relative to said web material prior to the source of said steam showers.

5. The process of claim 4 wherein said web material comprises a coated paper sheet.

6. The process of claim 5 wherein said steam showers are provided by at least one steam pipe positioned beneath said web material having steam emitting orifices located at the center line of said pipe.

7. The process of claim 6 wherein said air supply means comprises at least one air foil, the leading edge thereof being positioned prior to said orifice of each of said respective steam source.

8. The apparatus of claim 3, wherein said respective air foil means is offset about $\frac{1}{2}$ to $\frac{3}{4}$ inch prior to said corresponding orifice of said respective steam pipe.

9. The apparatus of claim 1, wherein said distance between said web material and said steam shower means is equal to about one-half the distance between said web stabilizing means and said steam shower means.

10. The apparatus of claim 9, wherein said distance between said web stabilizing means and said steam shower means is from about $\frac{1}{4}$ to about $1\frac{1}{2}$ inches.

11. The process of claim 7, wherein said leading edge of said respective air foil means is offset about $\frac{1}{2}$ to $\frac{3}{4}$ inch prior to said corresponding steam source orifice.

12. The process of claim 4, wherein said distance between said web material and said steam source means is equal to about one-half the distance between said web stabilizing means and said steam source means.

13. The process of claim 12, wherein said distance between said web stabilizing means and said steam source means is from about $\frac{1}{4}$ to about $1\frac{1}{2}$ inches.

* * * * *